US005167743A

United States Patent [19]

Chalfin

[11] Patent Number: 5,167,743

[45] Date of Patent: Dec. 1, 1992

[54] METHOD AND APPARATUS FOR ATTACHING DECORATIVE ARTICLES TO FABRIC

[75] Inventor: Neil Chalfin, New York, N.Y.

[73] Assignee: Margola Import Corp., New York, N.Y.

[21] Appl. No.: 736,210

[22] Filed: Jul. 26, 1991

[51] Int. Cl.[5] ..... B44C 1/165

[52] U.S. Cl. ..... 156/230; 156/235; 156/580; 221/173

[58] Field of Search ..... 156/230, 580, 235, 583-588; 428/914, 187, 200, 40; 221/173; 112/404

[56] References Cited

U.S. PATENT DOCUMENTS 4,204,610 5/1980 Schlaepfer ..... 156/235

*Primary Examiner*—David A. Simmons
*Assistant Examiner*—Robert Barker
*Attorney, Agent, or Firm*—Gottlieb, Rackman & Reisman

[57] ABSTRACT

A method and apparatus for attaching decorative articles to a fabric material having a face and a back surface comprising the steps of contacting a fixture having a pattern of bevelled depressions in a flat surface thereof with a plurality of decorative articles having heat sensitive adhesive backing on a substantially flat surface thereof.

11 Claims, 6 Drawing Sheets

METHOD AND APPARATUS FOR ATTACHING DECORATIVE ARTICLES TO FABRIC

BACKGROUND OF THE INVENTION

The present invention relates to a method and apparatus for attaching decorative articles to a fabric material In particular it relates to such a method and apparatus for attaching decorative jewelry articles having adhesive backing to a fabric in a decorative pattern.

Decorative jewelry articles such as rhinestones may be purchased in patterns attached to transfer tape. In order to attach such articles to a fabric material it is required to peel a backing material from the transfer tape exposing an adhesive backing on the decorative articles, place the adhesive backing in contact with a fabric material and apply heat by a pressing or ironing method to cause the fabric to adhere to the decorative articles, and then remove the tape. The major drawback to that method is the high cost associated with purchasing the articles attached to the transfer tape, that cost being due to the laborious methods used to place the articles on the tape. Furthermore one is limited to the patterns that are predetermined by the manufacturer of the loaded transfer tape. Although custom patterns may be ordered, that further increases the expense and the delay associated with obtaining the loaded tapes.

The present invention overcomes this limitation by providing a loader plate that allows the convenient manipulation of decorative articles in a virtually unlimited number of decorative patterns and a method of using the plate to facilitate the loading and adhesion of the decorative articles to fabric. The system allows the avoidance of the high fixed cost associated with orders of limited quantities of preset transfer designs thereby also avoiding accumulative inventories.

BRIEF DESCRIPTION OF THE INVENTION

It is an object of the present invention to provide a method for attaching decorative articles to a fabric material having a face and a back surface comprising the steps of contacting a fixture having a pattern of bevelled depressions in a flat surface thereof with a plurality of decorative articles having heat sensitive adhesive backing on a substantially flat surface thereof, moving said decorative articles relative to the surface of said fixture wherein each bevelled depression is filled with a decorative article, such that said substantially flat surface lies parallel to and preferably above the level of the surface of the fixture, removing those decorative articles from the surface of the fixture which have not been moved into a bevelled depression, contacting the flat surface of said fixture and the substantially flat surfaces of the decorative articles with the face of said fabric material, applying heat press means to the back surface of said fabric material, whereby said decorative articles adhere to said fabric material in a pattern which is the same as the pattern of bevelled depressions and removing said fabric and decorative articles from said fixture.

It is a further object of the present invention to provide the aforesaid method for attaching decorative articles to the fabric material, wherein said bevelled depressions include perforations that pass completely through said fixture.

It is a still further object of the present invention to provide such a method for attaching decorative articles to the fabric material, wherein said bevelled depressions comprise sets of bevels of two or more diameters and said step of moving said decorative articles allows smaller such articles to pass through the depressions having larger diameters facilitating a two step process in which articles of two sizes are applied in a pattern.

It is a still further object of the present invention to provide such a method for attaching decorative articles to a fabric material, wherein said fixture has large openings therein and said step of removing decorative articles includes passing decorative articles through said large openings.

It is a still further object of the present invention to provide such a method for attaching decorative articles to a fabric material, wherein said contacting step comprises using a second fixture pre-loaded with articles in face to face with the first fixture to facilitate partial loading of a pattern.

It is a still further object of the present invention to provide the fixture including the loader plate to accomplish the method set forth in preceeding objects of the invention.

BRIEF DESCRIPTION OF THE DRAWINGS

The above description, as well as further objects, features and advantages of the present invention, will be more fully appreciated by reference to the following detailed description of a presently preferred, but nonetheless illustrative, embodiment in accordance with the present invention when taken in conjunction with the accompanying drawings wherein.

DETAILED DESCRIPTION OF A PREFERRED EMBODIMENT

A preferred embodiment of the invention will now be described with reference to the aforesaid figures.

Figure 1:
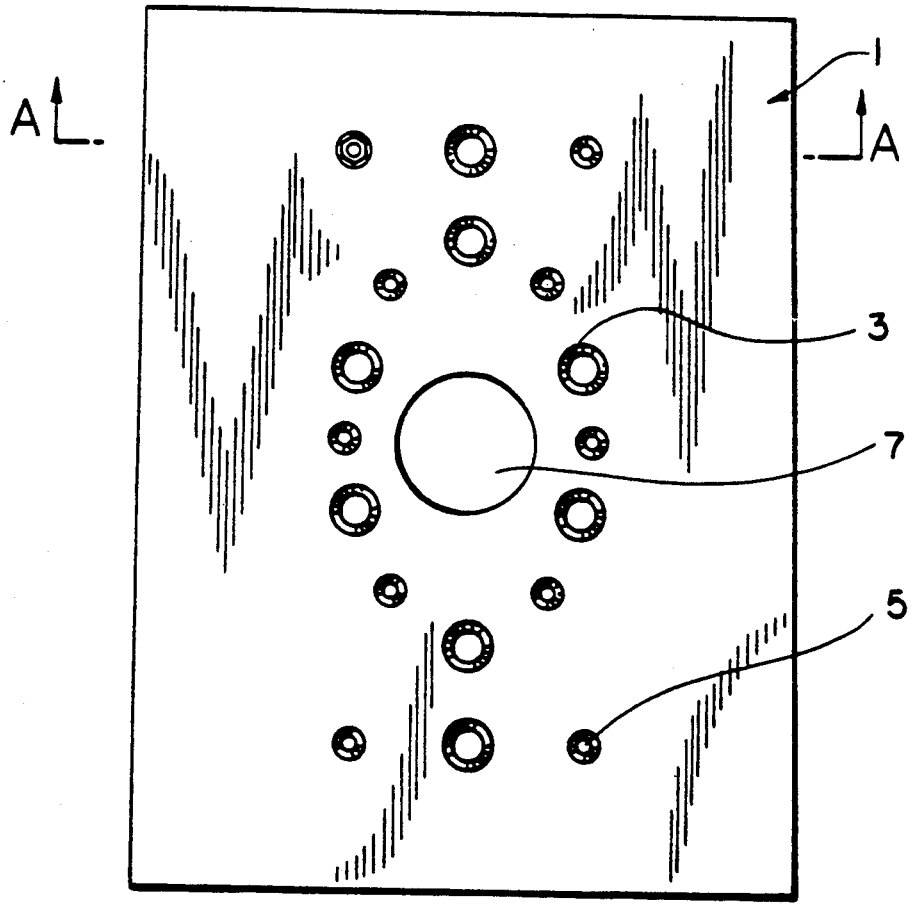
FIG. 1 is a top plan view of an embodiment of the fixture of the present invention.
Figure 2:
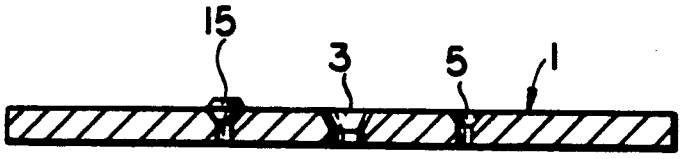
FIG. 2 is a cross section view of the embodiment of FIG. 1 along the line A—A.

As shown in FIG. 1, the invention utilizes a fixture comprising a loader plate 1 having bevelled openings of a larger diameter 3 or a smaller diameter 5 in a decorative pattern. A large hole 7, substantially larger than the largest diameter of any of the bevelled openings may also be present. It is not however essential to this invention that there be bevelled openings of two different diameters, nor the large hole. FIG. 2 shows a cross section A—A through the loader plate that passes through several bevels As shown in FIG. 2 the bevels may pass completely through the loader plate. One advantages in doing so are to keep the bevels clear of accumulated dirt or adhesive. The loader plate may be fashioned of metal, plastic or fibre and may be made by counterboring bevels in the surface of the plate by the use of a vertical mill or a drill press. If a plastic is used it must be able to withstand the heat that will be used to adhere the decorative articles to a fabric material.

Figure 3:
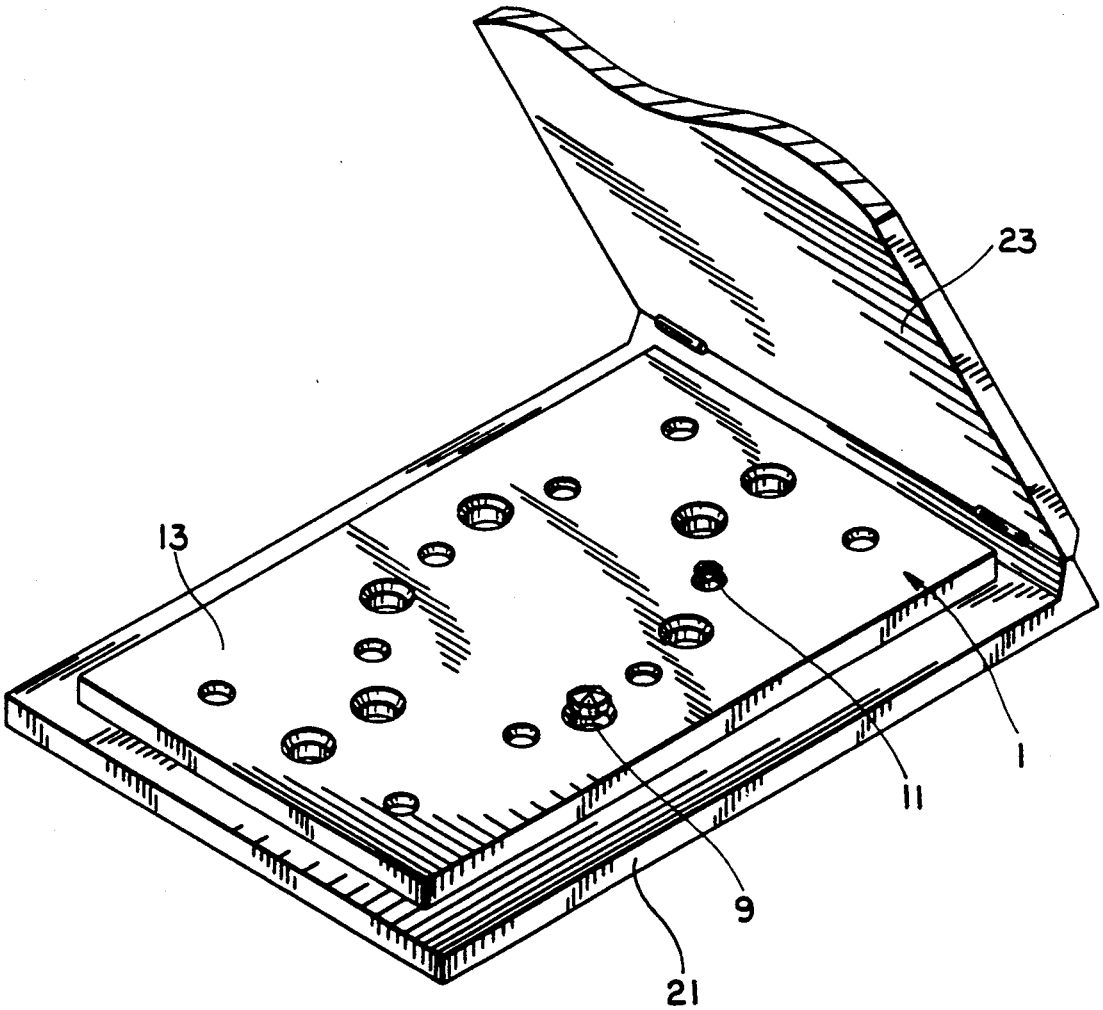
FIG. 3 is a perspective view of the fixture of the present invention.
Figure 4:
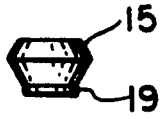
FIG. 4 is a vertical cross section of a decorative article used in connection with the present invention.
Figure 5:
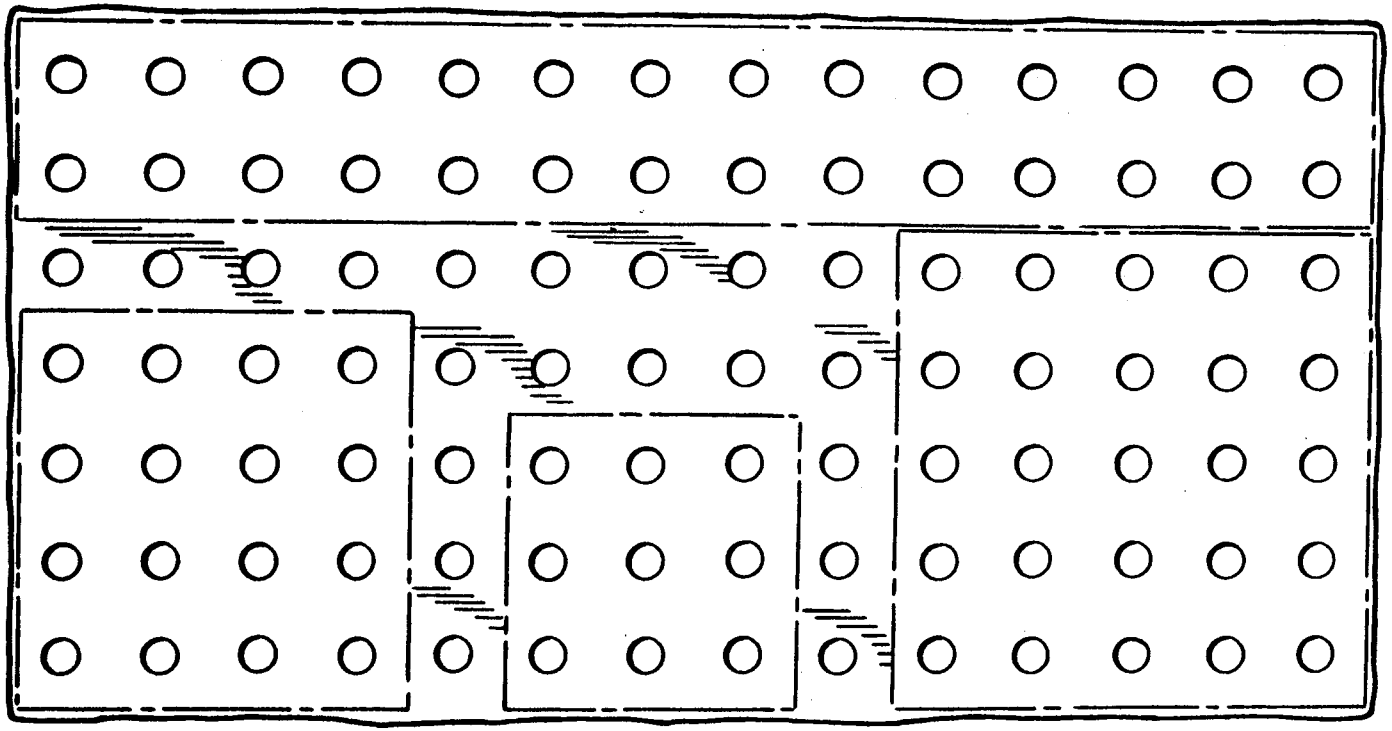
FIGS. 5–10 are top plan views of the universal loader plate of the present invention showing different masks to create different decorative patterns
Figure 6:
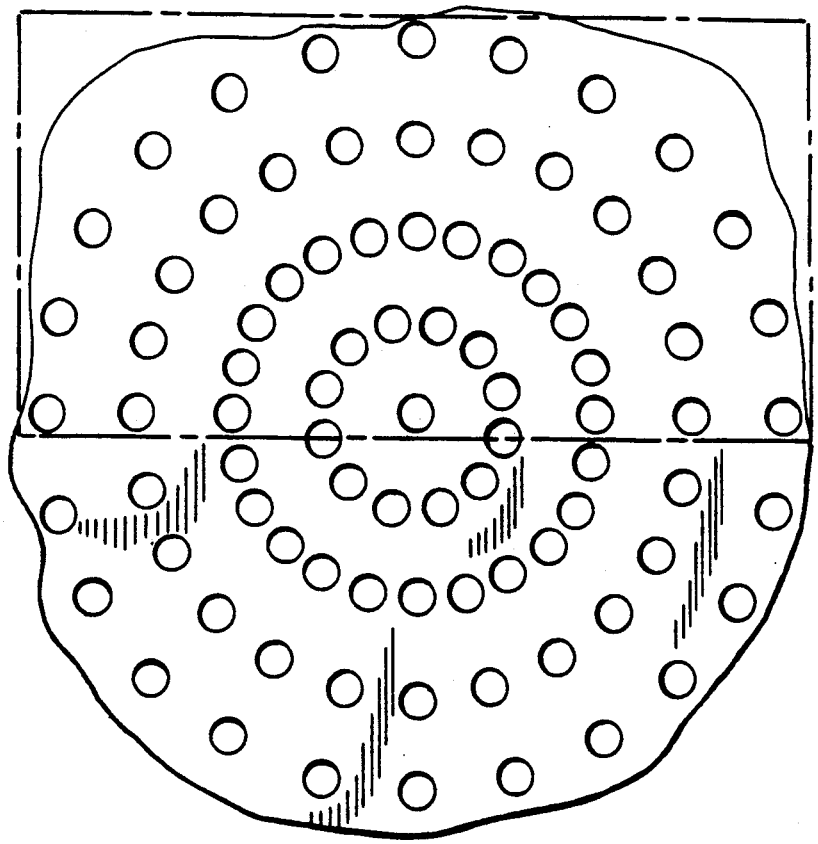
Figure 7:
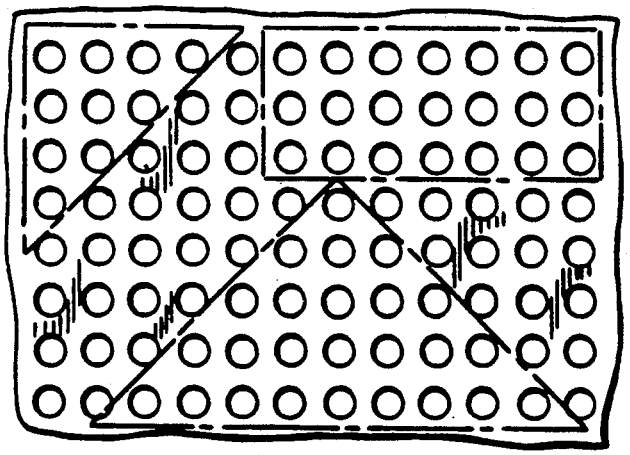
Figure 8:
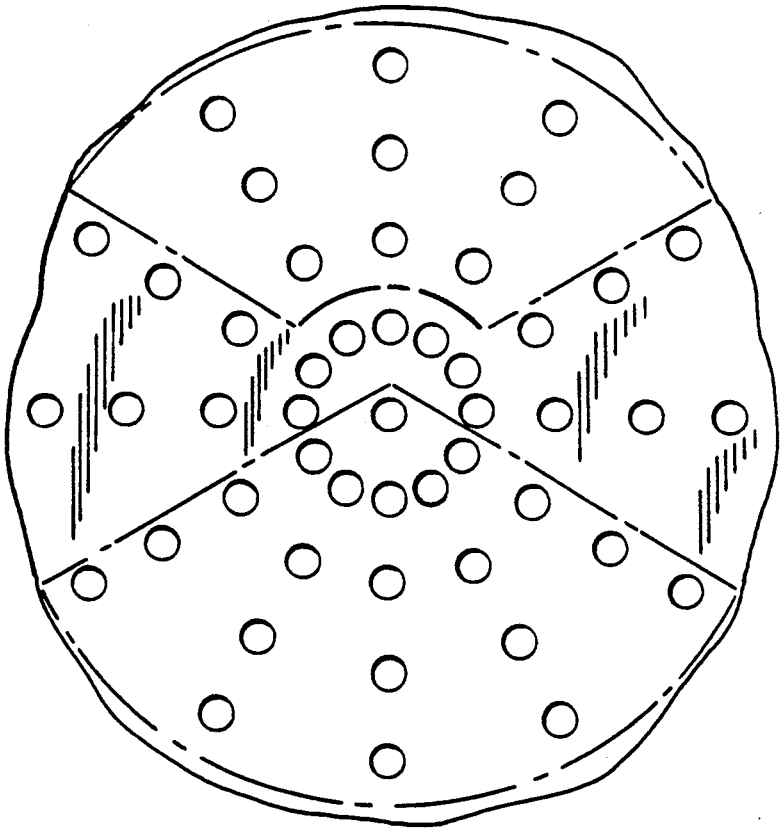
Figure 9:
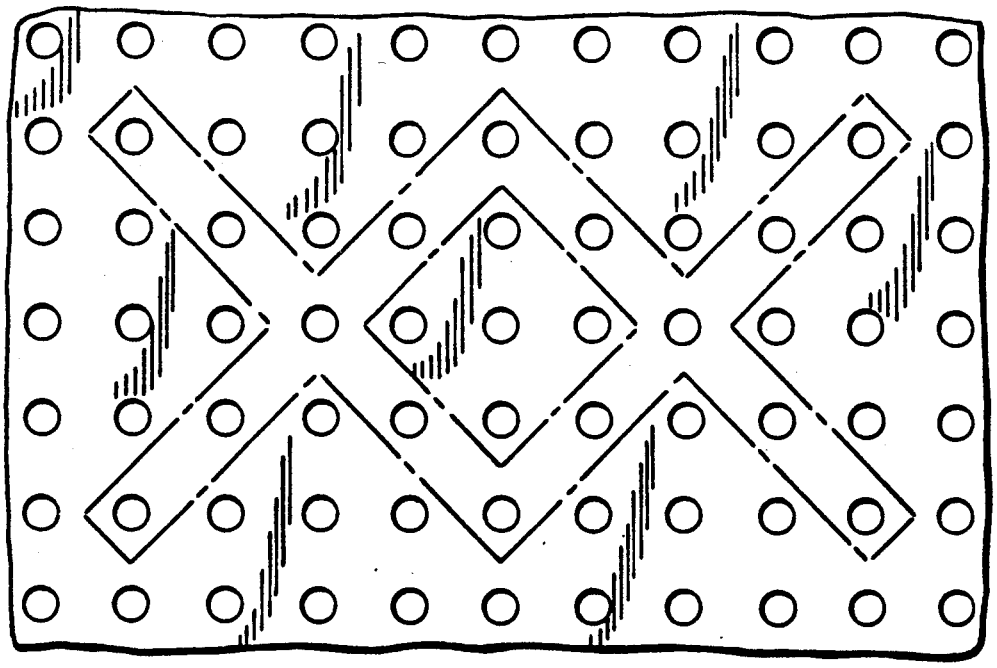
Figure 10:
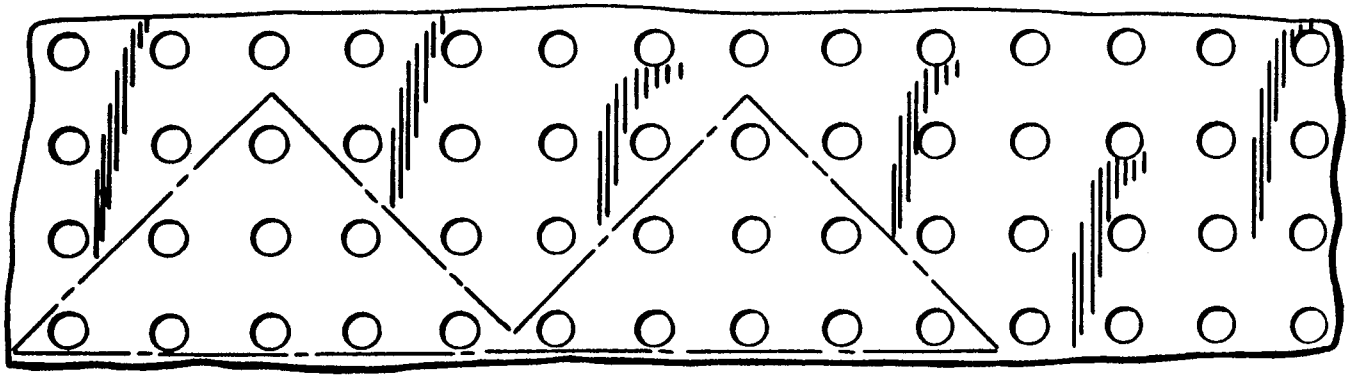

As indicated in FIG. 3, decorative articles, for example rhinestones of a larger size 9 or a smaller size 11 may be scattered on the surface 13 of the loader plate. FIG.

4 depicts a typical decorative article 15, for example a rhinestone having a decorative faceted face 17, and an adhesive backing 19. The adhesive may be pressure sensitive or heat sensitive to enable the article to be affixed to fabric material Such adhesives are well known to persons of ordinary skill in this art. As shown in FIG. 2, the bevel of the loader plate is configured so that the decorative article fits within its opening with the adhesive surface above the level of the surface 13 of the loader plate. This will facilitate contact of the adhesive surface with the fabric material and allow pressure to be applied selectively to the adhesive portion of the decorative article The decorative articles 9 and 11 may be rhinestones, half pearls, or other jeweled articles that are desired to be adhered to fabric. The articles are fabricated with their center of gravity displaced away from the adhesive surface and preferably close to their decorative surface so that they naturally lie on a surface with their adhesive surface uppermost as depicted in the figures. The configuration of the facets also facilitates their lying with their adhesive surface uppermost.

The fixture may also comprise a press having an immovable support plate 21 and a moveable plate 23, adapted to compress the upper surface of the loader plate 1. The moveable plate 23 may also have heat means (not shown) to cause it to bear down on any fabric which is placed on the upper surface of the loader plate and to heat the fabric.

Large holes such as 7 shown in FIG. 1 may be present through the fixture to allow decorative articles that are scattered away from the decorative pattern of bevels to pass through the fixture.

In use, the fixture is placed in a horizontal position and decorative articles are scattered on its surface. Where there are articles of two different sizes, the smaller ones are first scattered over the surface. The articles are moved across the surface until they either rest in the bevels with their decorative faces downwards and their adhesive surfaces upwards, or they are passed through the holes in the fixture, or pushed off its surface. Those holes may comprise either the large holes referred to or the hole in the lower potion of the bevel. The smaller decorative articles pass through the holes in the larger bevels so that none of the smaller articles remain fixed in the larger bevels After the smaller bevels are filled the procedure is repeated with the larger decorative articles. Although the process has been described with articles of two sizes, it is clear that with a proper configuration of bevel sizes the process may be used with decorative articles of more than two different sizes, the smaller sizes being seated before the next larger size.

After all the decorative articles are seated in the appropriate bevels and all unseated such articles have been removed from the surface of the loader plate a fabric material is placed over the surface contacting the adhesive surface of the articles. The moveable plate is then closed over the fabric and heat and pressure applied resulting in adhesion of the decorative article to the fabric. The combination may then be removed from the fixture.

FIGS. 5 through 10 depict the use of a universal loader plate. Such a plate has a regular array of bevels of one size. Decorative designs may be formed in the plates as shown by the use of a thin masking material which blocks entrance to groups of the bevels allowing only decorative arrangement of bevels to receive the decorative articles. Then the plate is used in the usual manner.

A way to rapidly load the universal plate without marking is to use a secondary loader plate which holds the decorative articles in the mirror image pattern by gravity, with the adhesive surface facing downward, i.e. upside down with regard to the normal loader plate. Upside down loading can be accomplished by modifying the bevel of the secondary loader plate and manually assuring that each decorative article has the appropriate orientation.

While there have been shown and described and pointed out the fundamental novel features of the invention as applied to preferred embodiments thereof, it will be understood that various omissions and substitutions and changes in the form and details of the device illustrated and in its operation may be made by those skilled in the art without departing from the spirit of the invention. It is the intention, therefore, to be limited only as indicated by the scope of the claims appended hereto.

I claim:

1. A method for attaching decorative articles to a fabric material having a face and a back surface comprising contacting a fixture having a pattern of bevelled depressions in a flat surface thereof passing completely through said fixture with a plurality of decorative articles having heat sensitive adhesive backing on a substantially flat surface thereof moving said decorative articles relative to the surface of said fixture wherein each bevelled depression is filled with a decorative article, such that said substantially flat surface lies parallel to and above the level of the surface of the fixture removing those decorative articles from the surface of the fixture which have not been moved into a bevelled depression contacting the flat surface of said fixture and the substantially flat surfaces of the decorative articles with the face of said fabric material applying heat press means to the back surface of said fabric material, whereby said decorative articles adhere to said fabric material in a pattern which is the same as the pattern of bevelled depressions and removing said fabric and decorative articles from said fixture.

2. The method for attaching decorative articles to the fabric material of claim 1, wherein said bevelled depressions comprise sets of bevels of a plurality of diameters and said step of moving said decorative articles allows smaller such articles to pass through the depressions having larger diameters.

3. The method for attaching decorative articles to a fabric material of claim 1, wherein said fixture has large openings therein and said step of removing decorative articles includes passing decorative articles through said openings.

4. The method for attaching decorative articles to a fabric material of claim 1 wherein, said contacting step comprises applying a second fixture face to face with the first fixture.

5. A method for attaching decorative articles to a fabric material having a face and a back surface comprising contacting a fixture having a pattern of bevelled depressions in a flat surface thereof passing completely through said fixture with a plurality of decorative articles having adhesive backing on a substantially flat surface thereof moving said decorative articles relative to the surface of said fixture wherein each bevelled depression is filled with a decorative article, such that said substantially flat surface lies parallel to the surface of the fixture removing those decorative articles from the surface of the fixture which have not been moved into a bevelled depression contacting the flat surface of said fixture and the substantially flat surfaces of the decorative articles with the face of said fabric material applying press means to the back surface of said fabric material, whereby said decorative articles adhere to said fabric material in a pattern which is the same as the pattern of bevelled depressions and removing said fabric and decorative articles from said fixture.

6. The method for attaching decorative articles to the fabric material of claim 5, wherein said bevelled depressions comprise sets of bevels of two or more diameters and said step of moving said decorative articles allows smaller such articles to pass through the depressions having larger diameters.

7. The method for attaching decorative articles to a fabric material of claim 5, wherein said fixture has large openings therein and said step of removing decorative articles includes passing decorative articles through said openings.

8. The method for attaching decorative articles to a fabric material of claim 5 wherein, said contacting step comprises applying a second fixture face to face with the first fixture.

9. A loader plate for attaching decorative articles to a fabric material having a face and a back surface comprising a fixture having a pattern of bevelled depressions in a flat surface thereof passing completely through said fixture adapted to receive a plurality of decorative articles having adhesive backing on a substantially flat surface thereof.

10. The loader plate of claim 1 wherein said bevelled depressions comprise sets of bevels of two or more diameters, wherein decorative articles having diameters smaller than the larger diameter of said bevels will pass completely through said fixture.

11. The loader plate of claim 9 wherein said loader plate has large openings therein adapted to allow decorative articles to pass therethrough.

* * * * *